United States Patent [19]

Greive

[11] 4,036,000

[45] July 19, 1977

[54] YARN TWISTING APPARATUS WITH SOUND AND WIND SHIELDING

[75] Inventor: Aloys Greive, Munster, Germany

[73] Assignee: Hamel GmbH Zwirnmaschinen, Munster, Germany

[21] Appl. No.: 724,462

[22] Filed: Sept. 17, 1976

[30] Foreign Application Priority Data

Sept. 18, 1975 Germany ..... 7529598[U]

[51] Int. Cl.[2] ..... D01H 1/00; G10K 11/04

[52] U.S. Cl. ..... 57/1 R; 57/108; 181/33 K

[58] Field of Search ..... 57/1 R, 34 R, 106, 108, 57/58.49; 181/33 R, 33 K

[56] References Cited

U.S. PATENT DOCUMENTS

| | | | |
|---|---|---|---|
| 3,146,572 | 9/1964 | Keyser | 57/1 R |
| 3,299,624 | 1/1967 | Nimtz | 57/108 |
| 3,641,757 | 2/1972 | Rehn | 57/34 R |
| 3,648,449 | 3/1972 | Greive | 57/108 X |
| 3,782,087 | 1/1974 | Franzen et al. | 181/33 R X |
| 3,955,347 | 5/1976 | Schippers | 181/33 K X |
| 3,977,169 | 8/1976 | Suzuki et al. | 57/1 R |

*Primary Examiner*—Donald Watkins

*Attorney, Agent, or Firm*—Karl F. Ross; Herbert Dubno

[57] ABSTRACT

A yarn-twisting apparatus has a frame on which is mounted at least one row of identical twisters. Fixed to this machine is a front wall panel extending along the row of twisters from the top of the cups thereof to the bottoms of these cups. Hinged on the upper edge of this front wall panel is one or a plurality of flaps which can move between a vertical position extending upwardly, or a lying-down position giving access to the tops of the twisters. Another such flap is hinged on a second front wall panel below and recessed from the front wall panel so as to be displaceable between an upper position shielding the arrangement and a lowered position giving access to the flyer disks of the twisters. These flaps and panels are all made of sound-deadening material and the various flaps may be subdivided so as to give access to individual twisters while the other flaps are left up so as to shield sound generated by the other twisters. Furthermore it is possible to provide two such rows of twisters on each machine with a vertical wall of sound-deadening material between the rows in order further to reduce the sound level generated by the machine. Wind shields are provided around each twister to prevent air currents generated by each twister from interfering with the operation of the adjacent twisters.

18 Claims, 5 Drawing Figures

YARN TWISTING APPARATUS WITH SOUND AND WIND SHIELDING

CROSS-REFERENCE TO RELATED APPLICATIONS

This application is related to my copending applications Ser. Nos. 725,494; 724,460, and 724,461 filed Sept. 22, 1976, Sept. 17, 1976 and Sept. 17, 1976, respectively.

FIELD OF THE INVENTION

The present invention relates to a twisting apparatus. More particularly this invention concerns a double-thread twisting machine having a plurality of twisters arranged on a common machine frame.

BACKGROUND OF THE INVENTION

It is common practice in twisting devices (see German Auslegeschrift DT-AS No. 21 30621) to provide a so-called bank or row of twisters along the machine frame, even to provide two such rows accessible from opposite sides of the machine. A single drive motor is provided for all of the twisters with a long flat belt extending past all of the whorls of the spindle shafts, mechanism being provided to move these whorls into and out of engagement with this flat belt.

Each twister typically comprises a flyer disk that is rotated by the whorl at high speed. Extending upwardly from this flyer disk is a balloon-limiting sleeve or cup and above this cup there is provided a takeup eye with a driven takeup mechanism that winds the filament with a constant speed onto a takeup spool. A yarn package is sested on a support resting via a bearing on the flyer disk so that this support can rotate relative to the flyer disk. An inlet tube extends upwardly coaxially with each of the spindle shafts and communicates with a radial passage in the flyer disk. Thus two yarn packages may be dropped down over the inlet tube and two yarns pulled off these packages, passed downwardly through the inlet tube and radially outwardly through the hole in the rotating flyer disk, then upwardly around the balloon-limiting cup through the guide eye onto the takeup device. The yarn package, as mentioned, remains stationary while the flyer disk is rotated at high speed so that considerable twist is imparted to the yarn which forms a so-called balloon around the cup in which the yarn packages are provided.

It has been found that when a plurality of such twisters operate simultaneously a high-pitched keening sound is produced which has been found to be extremely objectionable by the operators of the machine. Indeed the noise produced by such an installation is often so unpleasant as considerably to impair operator efficiency.

It has also been discovered that each of the twisters tends to produce a small tornado-like turbulence. These various turbulences interfere with each other so that the yarns of adjacent twisters often are deflected, causing a breakage and tangles to result in the apparatus.

It has been suggested to provide various types of sound screens and wind shields. None of the devices suggested has, however, enabled the operators of the machines readily to have access to the necessary parts while reducing the above-mentioned wind and noise problem.

OBJECTS OF THE INVENTION

It is therefore an object of the present invention to provide an improved twisting apparatus.

Yet another object is to provide such a twisting apparatus wherein the sound level generated by the machine is greatly reduced, but wherein access can readily be had to any of the service-needing parts of the individual twisters.

Yet another object is to provide a twisting apparatus wherein potentially harmful wind currents are contained as much as necessary to prevent malfunction of the machine.

SUMMARY OF THE INVENTION

These objects are attained according to the present invention in a twisting apparatus wherein a front wall panel is secured to the machine frame and extends along the row of yarn twisters. This front wall panel has an upper edge generally level with the tops of the cups of the twisters and a lower edge generally level with the bottoms of these cups. An upper wall flap is displaceable between an operational position extending upwardly from the upper edge of the front wall panel and a service position giving access past this upper edge to the twisters. A lower wall flap is provided which is displaceable between an operational position extending downwardly from the lower edge of the front wall panel and a service position giving access past this lower edge to the twisters. The flaps in the front wall panel are all at least partially made of sound-deadening material, by which is meant sound-absorbing material or a sound-deflecting material.

According to another feature of this invention the upper flap is secured by means of a hinge to the upper edge of the front wall panel. This upper flap can therefore be swung down through at least 90° and, in actuality, approximately 180° from a vertical position forming a vertical upward continuation of the front wall panel into another vertical position lying flatly against the front wall panel completely out of the way of the service personnel. In its erected operation position the upper flap extends upwardly beyond the upper end of the inlet tube of the twisters so as efficiently to shield noise produced by each twister.

The lower flap is provided in the region of the flyer disks of the twisters so as to be displaceable out of the way and give access to these disks. These lower flaps are hinged at their lower edges and can, therefore, be swung out of the way downwardly. They are held in their upper positions by means of magnetic catches engaged with ferromagnetic or steel portions on the frame or on the cover sheets for the front wall panel.

According to yet another feature of this invention there is provided a second front wall panel secured fixedly to the machine frame and recessed behind the first-mentioned front wall panel. This second wall panel is formed as a pair of parallel strips separated by a gap through which access can be had to the drive-operating levers which serve to displace the whorls of the twisters into and out of engagement with the drive belt. The drive belt itself is level with the upper strip of the second front wall part which itself is slightly outward of the lowermost strip, so that again a very efficient shielding is achieved even of the mechanism inside the frame of the machine. The lower flaps are hinged on the upper edges of the upper strips of the second front wall panel so that they can be swung downwardly through approximately 90° . To this end the hinge for the lower flaps bridges between the recessed second front wall panel and the first wall panel, giving the lower flap an L-section.

Although it is entirely possible to provide a single upper flap extending the full length of the machine along with a single lower flap extending similarly the full length of the machine, it is also a provision of this invention that the upper and lower flaps are subdivided into a plurality of sections each having a length equal approximately to the length of one twister. The twisters themselves are provided with wind shields each of which has a vertical slot and each of which extends substantially from the inlet tube down to the bottom of the limiter cup. This slot of each wind shield lies in a plane perpendicular to the direction of elongation of the twisters and lying on the rotation axis for the respective spindle, so that it lies approximately in the middle of each twister. The upper and lower flaps are similarly subdivided along this plane so that the operator drops down two flaps for access to a given twister, thereby giving himself or herself sufficient room to load or service the respective twister.

With all of the above arrangements the walls, panels and flaps are formed of a mass of sound-deadening material carried on at least one skin of synthetic-resin material or metal. When only one skin is used this is turned toward the outside so that the sound-absorbing mass is turned toward the inside of the machine and can therefore absorb the sound generated thereby. It is possible in accordance with this invention to form at least the front wall portion of the wind shield for each of the twisters as an integral portion of the front wall panel extends along the machine.

Furthermore, in an apparatus having a pair of horizontally parallel rows of such twisters the present invention envisages the provision of a vertical wall extending between these twisters from the bottom of the cups thereof upwardly to the winding or takeup devices. This wall may comprise a single panel above the upper level of the cups, a horizontal panel extending therebelow, and then two vertical panels each of which may also constitute the back portion of the respective wind shields.

With the system according to the present invention it is possible to reduce the noise generated by the multiple twister apparatus to a fraction of that which is normally created by such a machine. At the same time access can readily lead to any of the twisters so that displacement of the screens out of the way has virtually no effect on operator efficiency and is more than outweighed by the increased operator comfort. Furthermore the screens according to this invention considerably dress up the twisting apparatus and make it substantially easier to clean and service these devices. The various screens reduce the generation of lint by these machines so that dirtying of adjoining areas and the concomitant hazard created by such lint are correspondingly reduced.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
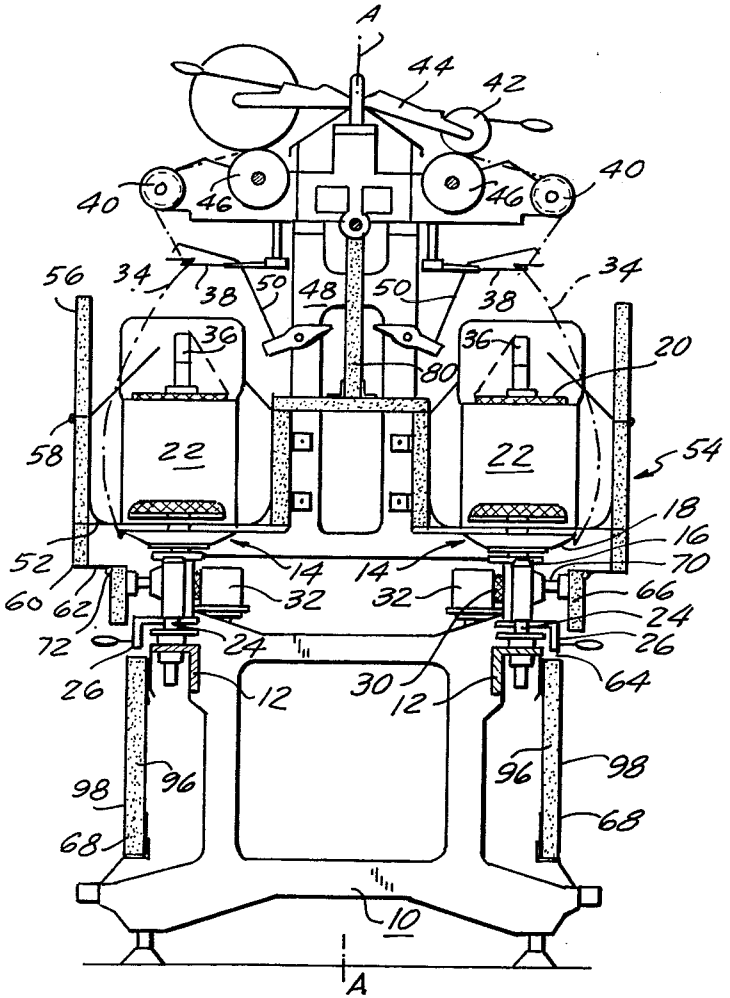
FIG. 1 is a vertical cross-section through a twisting apparatus in accordance with this invention.

The twisting apparatus shown in FIG. 1 has a large horizontally elongated machine frame or stand 10 which is symmetrical about avertical plane A—A. This frame 10 has a pair of spindle-support beams 12 on each of which is supported a row of identical twisters 14.

Each of the twisters 14 as best seen in FIG. 1 has a vertical drive shaft 16 on which is secured a flyer/reservoir disk 18. A yarn package is supported on each of the spindles 16 but is rotatable relative to this spindle 16. Snugly surrounding each of the yarn packages 20 is a sleeve or cup 22 serving as an inner balloon limiter and preventing the yarn that is pulled off the package 20 from fouling with the balloon formed around it. Each of the shafts 16 is secured on a mount 24 displaceable by means of a handle 26 so that the whorl 28 of the shaft 16 can be moved into and out of displacement with a drive belt 30. Drive and idler rollers 32 are provided for continuously displacing this belt 30 for joint driving of all of the twisters 14.

Each of the twisters 14 is further provided with an inlet tube 36 in which a thread brake such as described in the above-cited copending application Ser. No. 725,494. The yarn is therefore pulled off of each of the packages 20 and passes through an eye 38 above the twister 14. Thereafter the yarn 34 which has been twisted is passed over an idler or deflecting roller 40 and wound up on a takeup spool 42 carried on an arm 44 and driven by a roller 46 at a constant peripheral velocity. A heavy frame 48 connected to the frame 10 carries the various takeup arrangements 46. Furthermore a filament-tension detector 50 is provided which operates the lever 26 by means of a solenoid in order to disconnect the respective twister 14 when a thread break is detected or when the filament runs out.

In addition each of the twisters 14 is surrounded at least at the level of its cup 22 with a wind shield 52. Furthermore a front wall 54 extends along the entire frame 10 substantially from the top of the cup 22 to the bottom of the cup 22 of each twister 14. At its upper edge the stationary front wall 54 is provided with a plurality of upper flaps 56 which are secured to this wall 54 by means of hinges 58. Each of the flaps 56 extends upwardly beyond the upper end of the respective inlet tube 36.

Figure 2:
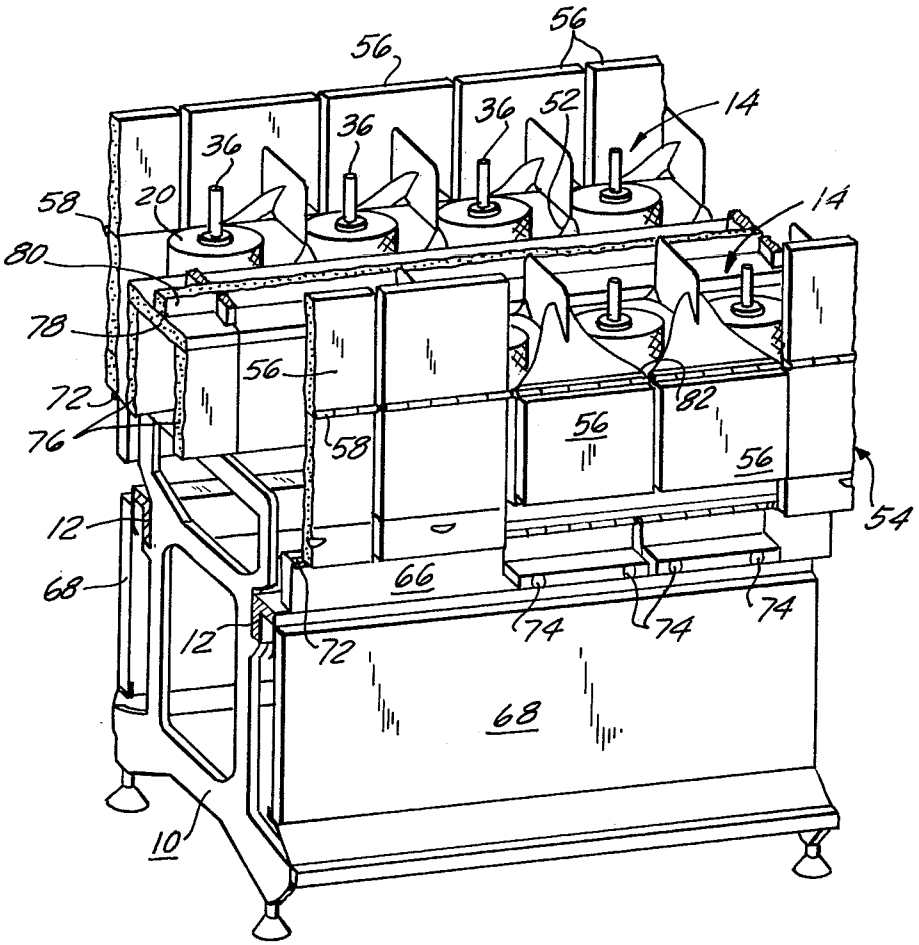
FIG. 2 is a partly broken-away perspective view of the apparatus of FIG. 1.

Furthermore the machine is provided with lower L-shaped flaps 60 whose upper edges abut the lower edge of the wall 54. Below these flaps 60 there are provided a pair of strips 66 and 68 separated by a gap 64 through which the levers or handles 26 extend. Holders 70 are provided for securing the strip 66 rigidly to the frame 10, with the strips 66 and 68 being recessed substantially behind the strip 54. A hinge 72 having a flap 62 is provided for securing the flaps 60 on the upper edges of the strip 66 in a position in line with the front wall 54. Furthermore magnetic catches shown at 74 in FIG. 2 are provided for securing the flaps 60 in their upper operational position.

As shown in FIG. 1 the various walls and flaps of the apparatus are formed of a mass of sound-absorbing material secured in a sheet-metal skin 98. The skin 98 is turned outwardly so that the machine can readily be cleaned and presents and attractive appearance, with the sound-absorbing material turned inwardly for greatest effectiveness. On its inner side each of the various panels and flaps therefore only has a thin lip of metal which serves merely to secure the sound-deadening material in place.

Along the back row of twisters 14 there is provided a short vertical wall 76, with a horizontal wall 78 bridging these two walls 76 at the top of the cups 22. From the middle of the wall 78 there extends upwardly another vertical wall 80 to the region of the takeup device 46, so that sound generation within the machine is also held to a minumum.

Each of the wind shields 52 is formed with a vertical slot 82 level with the respective shaft 16 and inlet tube 36. This slot 82 serves to help thread the device, as customarily the arrangement is pneumatically threaded by blowing the filament 34 downwardly through the inlet 36 by means of an apparatus such as described in the above-mentioned application Ser. No. 724,460. Then the filament is pulled upwardly through the slot 82 and fed through the eye 38, over the roller 40, and connected to the takeup spool 42. In accordance with this invention the flaps 56 and 60 are subdivided along lines level with this slot 82 and the wall 54 is similarly subdivided and formed with slits level with this slot 82.

Figure 4:
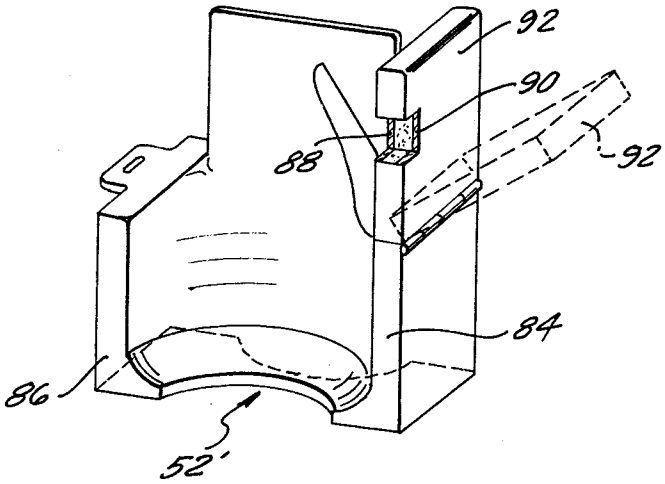
FIG. 4 is a perspective partly broken-away view of a wind screen in accordance with the present invention.

As shown in FIG. 4 each of the wind screens can therefore be formed of a pair of halves 52' having a front wall part 84, and a rear wall part 86. As shown the arrangement is double-walled and formed of a pair of skins 88 between which is provided a mass of sound-absorbing material 92. The front wall 84 may constitute the respective portion of the wall 54 and the upper flap 92 hinged thereon may constitute half of the respective flap 56.

Figure 3:
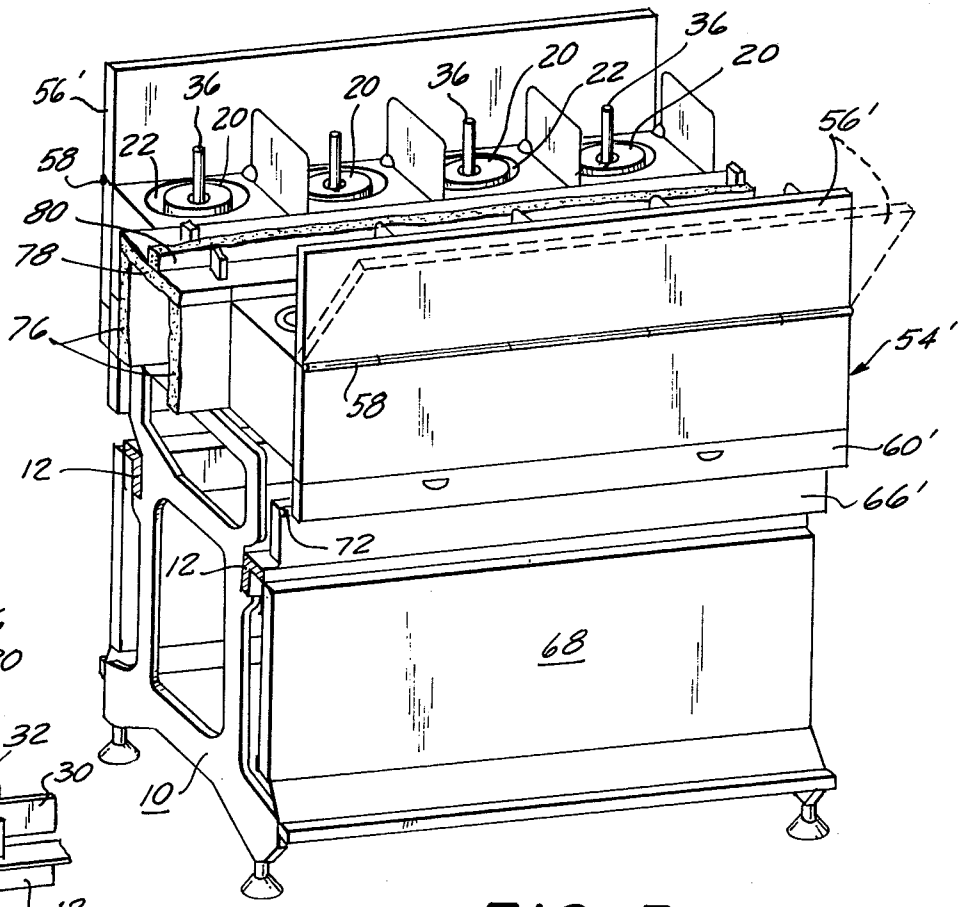
FIG. 3 is a view similar to FIG. 2 showing another twisting apparatus in accordance with this invention.

It is possible as shown in FIG. 3 to provide a single upper flap 56' along with a single lower flap 60'. In this case similarly the wall 54' is not subdivided so that the entire arranger presents a very neat appearance. With such a device it is nonethe less necessary to flap down the entire panel 56' or 60' in order to service any of the twisters.

Figure 5:
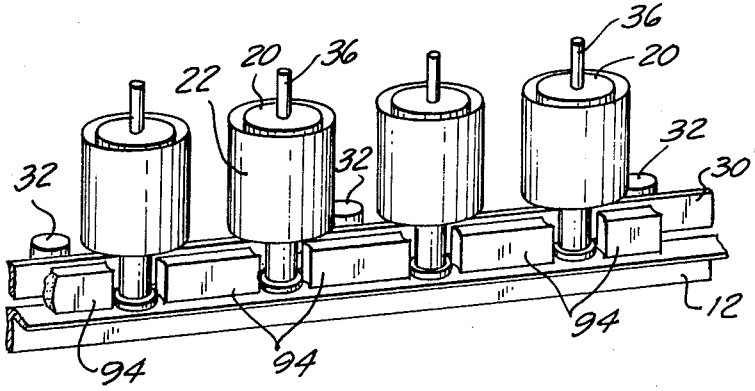
FIG. 5 is a perspective view of a variant on another form of the present invention.

Finally FIG. 5 shows an arrangement wherein blocks 94 of insulating material made as shown in FIGS. 4 or 1 are provided between the whorls 28 on the support beam 12. Such blocks further decrease the unpleasant sound produced by the drive belt so as again to make working with the apparatus according to the invention substantially easier, thereby increasing operator efficiency.

With the system according to the present invention it is therefore possible to quiet down a normally noisy twisting apparatus so that it does not disturb operators of adjoining machines and the operator of the twisting machine itself is not subjected to a high efficiency-impairing noise level. Furthermore such an arrangement reduces the generation of lint by the machine and prevents air currents from each twister from interfering with the other twisters so that malfunction of the machine is greatly reduced.

I claim:

1. A twisting apparatus comprising:

a frame;

a row of yarn twisters extending along said frame and each having a balloon-limiting cup;

a front wall panel secured to said frame extending along said twisters and having an upper edge generally level with the tops of said cups and a lower edge generally level with the bottoms of said cups;

an upper wall flap displaceable between an operational position extending upwardly from said upper edge and a service position giving access past said upper edge to said twisters; and a lower wall flap displaceable between an operational position extending downwardly from said lower edge and a service position giving access past said lower edge to said twisters, said flaps and said front wall panel being at least partially made of sound-deadening material.

2. The apparatus defined in claim 1 wherein said lower flap is hinged below said lower edge and swingable outwardly and downwardly away from said frame.

3. The apparatus defined in claim 1 wherein each of said twisters has a flyer disk, said lower flap extending downwardly past said disks.

4. The apparatus defined in claim 1 wherein said upper flap is hinged on said upper edge and swingable outwardly and downwardly away from said operational position through at least 90°.

5. The apparatus defined in claim 4 wherein said upper flap is swingable through substantially 180° and lies flatly against said front wall panel in said service position.

6. The apparatus defined in claim 1 wherein each of said twisters has above the top of its cup an inlet tube, said upper flap extending upwardly in said operational position past said inlet tubes.

7. The apparatus defined in claim 1, further comprising a second front wall panel separate from the first-mentioned front wall panel and extending along said frame below said lower flap.

8. The apparatus defined in claim 7 wherein said second front wall panel has an upper dge and said lower flap is hinged on same.

9. The apparatus defined in claim 8 wherein said second front wall panel is recessed and lies in a plane parallel to that of said first front wall panel, said apparatus further comprising a hinge bridging between said second front wall panel and said lower flap.

10. The apparatus defined in claim 8 wherein said lower flap is provided with at least one magnetic catch for holding same in said operation position.

11. The apparatus defined in claim 7 wherein each of said twisters is provided below the bottom of its cup with a whorl-placement lever, said second front wall panel being formed with openings aligned with said levers.

12. The apparatus defined in claim 11 wherein said second front wall panel is formed as a pair of strips secured to said frame and separated by a gap constituting said openings.

13. The apparatus defined in claim 1 wherein each of said twisters is provided with a wind shield haing a slot extending vertically the full length of the respective cup, said front wall being similarly formed with a plurality of vertical slits aligned with said slots.

14. The apparatus defined in claim 13 wherein each of said flaps is subdivided at said slits into a plurality of individually displaceable sections.

15. The apparatus defined in claim 1 wherein each of said flaps is undivided and extends past a plurality of said twisters.

16. The apparatus defined in claim 1 wherein each of said twisters is provided with a wind shield surrounding its cup and each of said wind shields has a front wall portion constituted by the corresponding region of said front wall panel, said wind shield being at least partially formed of a mass of sound-absorbing material sandwiched between a pair of skins.

17. The apparatus defined in claim 1, further comprising a second row of such twisters extending horizontally parallel to the first-mentioned row and a vertical sound-absorbing wall between said rows extending at least in the regions of the cups thereof.

18. The apparatus defined in claim 17 wherein said twisters have above the tops of said cups respective takeup devices, said vertical wall extending upwardly to the region of said take-up devices.

* * * * *